US005505167A

United States Patent [19]

Kennedy

[11] Patent Number: 5,505,167

[45] Date of Patent: Apr. 9, 1996

[54] INTERNAL COMBUSTION ENGINE BLOCK HAVING A CYLINDER LINER SHUNT FLOW COOLING SYSTEM AND METHOD OF COOLING SAME

[75] Inventor: Lawrence C. Kennedy, Bingham Farms, Mich.

[73] Assignee: Detroit Diesel Corporation, Detroit, Mich.

[21] Appl. No.: 376,070

[22] Filed: Jan. 20, 1995

Related U.S. Application Data

[63] Continuation of Ser. No. 223,462, Apr. 5, 1994, abandoned, which is a continuation-in-part of Ser. No. 57,451, May 5, 1993, Pat. No. 5,299,538.

[51] Int. Cl.[6] ..... F02F 1/10

[52] U.S. Cl. ..... 123/41.84; 123/41.79

[58] Field of Search ..... 123/41.79, 41.83, 123/41.84

[56] References Cited

U.S. PATENT DOCUMENTS

| | | | |
|---|---|---|---|
| 1,968,449 | 7/1934 | Hefti | 123/41.83 |
| 2,413,753 | 1/1947 | Dittmar | 123/41.79 |
| 2,474,878 | 7/1949 | Winfield | 123/41.83 |
| 3,363,608 | 1/1968 | Scherenbert et al. | 123/41.84 |
| 3,659,569 | 5/1972 | Mayer et al. | 123/41.79 |
| 3,714,931 | 2/1973 | Neitz et al. | 123/41.79 |
| 3,865,087 | 2/1975 | Sihon | 123/65 |
| 4,050,421 | 9/1977 | Cendak | 123/41.81 |
| 4,172,435 | 10/1979 | Schumacher | 123/41.72 |
| 4,365,593 | 12/1982 | Pomfret | 123/41.32 |
| 4,413,597 | 11/1983 | Stang et al. | 123/41.42 |
| 4,440,118 | 4/1984 | Stang et al. | 123/41.84 |
| 4,601,265 | 7/1986 | Wells et al. | 123/41.28 |
| 4,640,236 | 2/1987 | Nakano et al. | 123/41.79 |
| 4,662,321 | 5/1987 | Devaux | 123/41.79 |
| 4,794,884 | 1/1989 | Hilker et al. | 123/41.79 |
| 4,926,801 | 5/1990 | Eisenberg et al. | 123/41.84 |
| 5,086,733 | 2/1992 | Inoue et al. | 123/41.84 |
| 5,150,668 | 9/1992 | Bock | 123/41.84 |

FOREIGN PATENT DOCUMENTS

| | | |
|---|---|---|
| 2323020 | 4/1977 | France . |
| 1220202 | 6/1966 | Germany . |
| 2511213 | 9/1976 | Germany . |
| 392091 | 5/1933 | United Kingdom . |
| 1525766 | 9/1978 | United Kingdom . |

*Primary Examiner*—Noah P. Kamen
*Attorney, Agent, or Firm*—Brooks & Kushman

[57] ABSTRACT

An internal combustion engine block having a circumferential channel formed between the cylinder block and a cylinder liner, surrounding and adjacent to the high temperature combustion chamber region of the engine, to which coolant flow is provided to uniformly and effectively cool this critical area of the liner. The flow characteristics of the top liner cooling channel provide a high velocity coolant stream having an aspect ratio of width relative to height within a predetermined range and an equivalent diameter within a predetermined range to assure uniform temperature on both sides of the cylinder liner and about the entire circumference of the liner.

8 Claims, 4 Drawing Sheets

INTERNAL COMBUSTION ENGINE BLOCK HAVING A CYLINDER LINER SHUNT FLOW COOLING SYSTEM AND METHOD OF COOLING SAME

CROSS-REFERENCE TO RELATED APPLICATION

This is a continuation of application(s) Ser. No. 08/223,462 filed on Apr. 5, 1994 ABN, which is a continuation-in-part application of U.S. Ser. No. 057,451, filed May 5, 1993, now U.S. Pat. No. 5,299,538 entitled "Internal Combustion Engine Block Having A Cylinder Liner Shunt Flow Cooling System And Method of Cooling Same" and is incorporated by reference herein.

TECHNICAL FIELD

This invention relates to internal combustion engines and particularly to fuel injected diesel cycle engines, and specifically to the construction of the cylinder block and cylinder liner to accommodate cooling of the liner.

BACKGROUND OF THE INVENTION

It is conventional practice to provide the cylinder block of an internal combustion engine with numerous cast in place interconnected coolant passages within the area of the cylinder bore. This allows maintaining the engine block temperature at a predetermined acceptably low range, thereby precluding excessive heat distortion of the piston cylinder, and related undesirable interference between the piston assembly and the piston cylinder.

In a conventional diesel engine having replaceable cylinder liners of the flange type, coolant is not in contact with the immediate top portion of the liner, but rather is restricted to contact below the support flange in the cylinder block. This support flange is normally, of necessity, of substantial thickness. Thus, the most highly heated portion of the cylinder liner, namely, the area adjacent the combustion chamber is not directly cooled.

Furthermore, uniform cooling all around the liner is difficult to achieve near the top of the liner because location of coolant transfer holes to the cylinder head is restricted by other overriding design considerations. The number of transfer holes is usually limited, and in many engine designs the transfer holes are not uniformly spaced.

All of the foregoing has been conventional practice in internal combustion engines, and particularly with diesel cycle engines, for many, many years. However, in recent years there has been a great demand for increasing the horsepower output of the engine package and concurrently there exists redesign demands to improve emissions by lowering hydrocarbon content. Both of these demands result in hotter running engines, which in turn creates greater demands on the cooling system. The most critical area of the cylinder liner is the top piston ring reversal point, which is the top dead center position of the piston, a point at which the piston is at a dead stop or zero velocity. In commercial diesel engine operations, it is believed that the temperature at this piston reversal point must be maintained so as not to exceed 400° F. (200° C). In meeting the demands for more power and fewer hydrocarbon emissions, the fuel injection pressure has been increased on the order of 40% (20,000psi to about 28,000 psi) and the engine timing has been retarded. Collectively, these operating parameters make it difficult to maintain an acceptable piston cylinder liner temperature at the top piston ring reversal point with the conventional cooling technique described above.

SUMMARY OF THE INVENTION

The present invention overcomes these short-comings by providing a continuous channel all around the liner and located near the top of the liner. Between 5 to 10% of the total engine coolant fluid flow can be directed through these channels, without the use of special coolant supply lines or long internal coolant supply passages. This diverted flow provides a uniform high velocity stream, all around and high up on the liner, to effectively cool the area of the cylinder liner adjacent to the upper piston ring travel, thus tending to better preserve the critical lubricating oil film on the liner inside surface. The resulting uniform cooling also minimizes the liner bore distortion, leading to longer service life. Further, the present invention requires but minor modification to incorporate into existing engine designs.

The present invention includes a circumferential channel formed between the cylinder block and cylinder liner, surrounding and adjacent to the high temperature combustion chamber region of an internal combustion engine, to which coolant flow is diverted from the main coolant stream to uniformly and effectively cool this critical area of the liner. Coolant flow through the channel is induced by the well known Bernoulli relationship between fluid velocity and pressure. The high velocity flow of the main coolant stream, through the passages that join the cylinder block with the cylinder head, provides a reduced pressure head at intersecting channel exit holes. Channel entrance holes, located upstream at relatively stagnant regions in the main coolant flow, are at a higher pressure head than the channel exit holes, thus inducing flow through the channel.

The present invention also includes providing a top of the liner cooling channel of a dimensional configuration yielding optimum heat removal characteristics at both the (i) gas or combustion side of the cylinder wall (to preclude oil deterioration, excessive wear, and the like), and (ii) coolant side of the cylinder wall to preclude the coolant boiling. This is accomplished by maintaining an aspect ratio of about 0.085:1 to about 0.175:1 and, preferably, at least about 0.130:1. It also accomplished by providing an equivalent diameter ranging from about 0.006 ft to about 0.0112 ft, and preferably, about 0.008 ft.

These and other objects of the present invention are readily apparent from the following detailed description of the best mode for carrying out the invention when taken in connection with the accompanying drawings.

BEST MODE FOR CARRYING OUT THE INVENTION

Figure 1:
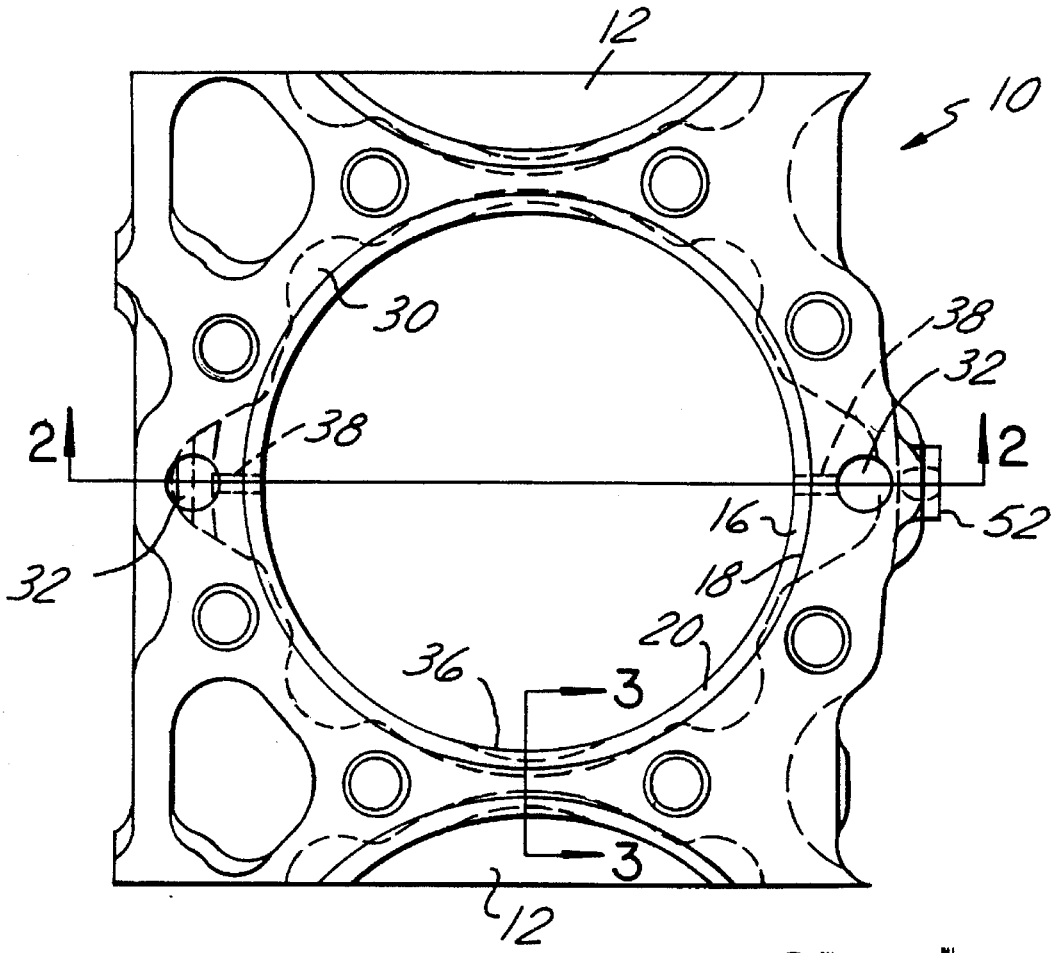
FIG. 1 is a partial plan view of the cylinder block showing a cylinder bore and partial views of adjoining cylinder bores, prior to installation of a cylinder liner, constructed in accordance with the present invention.
Figure 3:
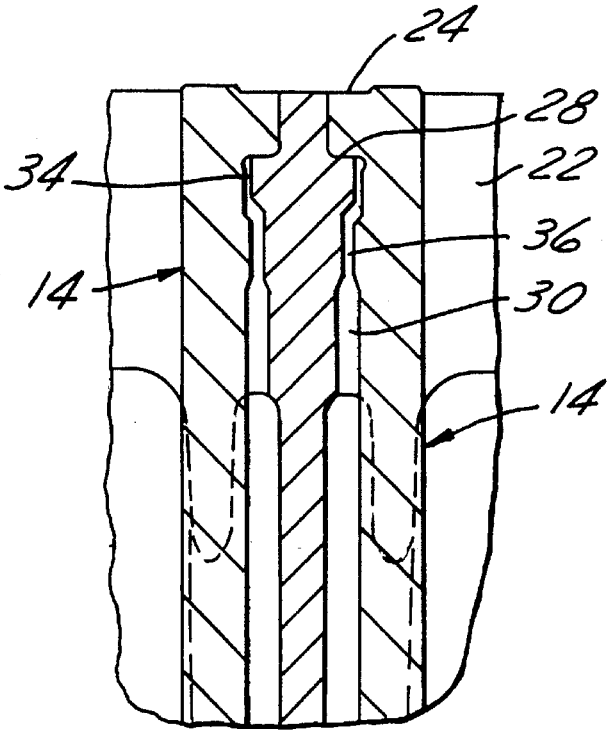
FIG. 3 is a sectional view taken substantially along the lines 3—3 of FIG. 1.
Figure 2:
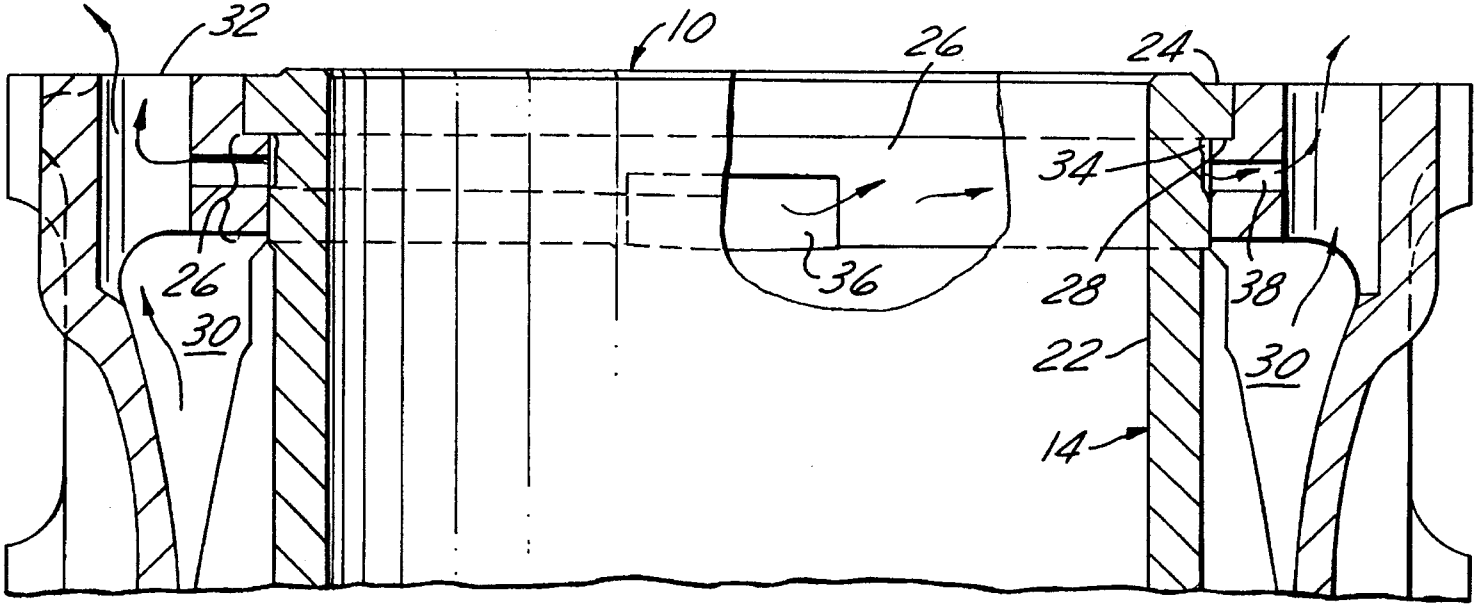
FIG. 2 is a sectional view taken substantially along the lines 2—2 of FIG. 1, but including the installation of the cylinder liner, and further showing in partial cross-section through the cylinder liner details of the coolant fluid channel inlet formed within the cylinder block in accordance with the present invention.

Pursuant to one embodiment of the present invention as shown in FIGS. 1–3, a cylinder block, generally designated 10 includes a plurality of successively aligned cylinder bores 12. Each cylinder bore is constructed similarly and is adapted to receive a cylindrical cylinder liner 14. Cylinder bore 12 includes a main inner radial wall 16 of one diameter and an upper wall 18 of greater diameter so as to form a stop shoulder 20 at the juncture thereof.

Cylinder liner 14 includes a radial inner wall surface 22 of uniform diameter within which is received a reciprocating piston, having the usual piston rings, etc., as shown generally in U.S. Pat. No. 3,865,087, assigned to the same assignee as the present invention, the description of which is incorporated herein by reference.

The cylinder liner 14 further includes a radial flange 24 at its extreme one end which projects radially outwardly from the remainder of an upper engaging portion 26 of lesser diameter than the radial flange so as to form a stop shoulder 28. The entirety of the upper engaging portion 26 of the cylinder liner is dimensioned so as to be in interference fit to close fit engagement (i.e. 0.0005to 0.0015inch clearance) with the cylinder block, with the cylinder liner being secured in place by the cylinder head and head bolt clamp load in conventional manner.

About the cylinder liner 12, and within the adjacent walls of the cylinder block, there is provided a main coolant chamber 30 surrounding the greater portion of the cylinder liner. A coolant fluid is adapted to be circulated within the main coolant chamber from an inlet port (not shown) and thence through one or more outlet ports 32.

The general outline or boundaries of the main coolant chamber 30 are shown in phantom line in FIG. 1 as surrounding the cylinder bore, and include a pair or diametrically opposed outlet ports 32.

Thus far, the above description is of a conventionally designed internal combustion engine as shown in the above-referenced U.S. Pat. No. 3,865,087.

As further shown in FIGS. 1–3, and in accordance with the present invention, a secondary cooling chamber is provided about the uppermost region of the cylinder liner within the axial length of the upper engaging portion 26. The secondary cooling chamber is provided specifically as a circumferentially extending channel 34 machined or otherwise constructed within the radially outer wall of the upper engaging portion 26 of the cylinder liner and having an axial extent or length beginning at the stop shoulder 28 and extending approximately half-way across the upper engaging portion 26.

The secondary cooling chamber includes a pair of fluid coolant passages in the form of inlet ports 36 diametrically opposed from one another and each communicating with the main coolant chamber 30 by means of a scalloped recess constructed within the radial inner wall of the cylinder block. Each scalloped recess extends in axial length from a point opening to the main coolant chamber 30 to a point just within the axial extent or length of the channel 34, as seen clearly in FIG. 2, and each is disposed approximately 90° from the outlet ports 32.

The secondary cooling chamber also includes a plurality of outlet ports 38. The outlet ports 38 are radial passages located at and communicating with a respective one of the outlet ports 32 of the main cooling chamber. The diameter of the radially directed passage or secondary cooling chamber outlet port 38 is sized relative to that of the main coolant chamber outlet port 32 such that it is in effect a venturi.

While not shown, it is to be appreciated that the top piston ring of the piston assembly is adapted to be adjacent the secondary cooling chamber when the piston assembly is at its point of zero velocity i.e., the top piston ring reversal point.

In terms of specific design for an internal cylinder bore diameter of 149.0mm (assignee's Series 60 engine), the important relative fluid coolant flow parameters are as follows:

| | |
|---|---|
| Circumferential channel 34: | |
| axial length (height) | 11.5–12.0 mm |
| depth | 1.0 mm |
| Scalloped recess (inlet port 36): | |
| radial length (depth) | 2.0 mm |
| cutter diameter for machining scallop | 3.00 inches |
| arc degrees circumscribed on cylinder bore | 20° |
| chord length on cylinder bore | 25.9 mm |
| Main cooling chamber outlet port 32: diameter | 15 mm |
| Secondary cooling chamber output port/ venturi/radial passage 38: | |
| diameter | 6 mm |
| pressure drop across venturi/output port 38 | 0.41 psi |
| coolant flow diverted through secondary cooling chamber | 7.5% |

Generally, the above-mentioned specific parameters are selected based upon maintaining the flow area equal through the ports 36, 38 (i.e. total inlet port flow area and total outlet port flow area) and channel 34. Thus in the embodiment of FIGS. 1–3, the flow area through each inlet port 36 and outlet port 38 is twice that of the channel 34.

In operation, as coolant fluid is circulated though the main coolant chamber 30, it will exit the main coolant chamber outlet ports 32 at a relatively high fluid velocity. For example, within the main chamber the fluid velocity, because of its volume relative to the outlet ports 32, would be perhaps less than one foot per second. However, at each outlet port 32 the fluid velocity may be in the order of seven to eight feet per second and would be known as an area of high fluid velocity. But for the existence of the secondary cooling chamber, the flow of coolant through the main coolant chamber would not be uniform about the entire circumference of the cylinder liner. Rather, at various points about the circumference, and in particular with respect to the embodiment shown in FIGS. 1–3 wherein there is provided two diametrically opposed outlet ports 32, a region or zone of coolant flow stagnation would form at a point approximately 90°, or half-way between, each of the outlet ports. This would create a hot spot with a potential for undesirable distortion, possible loss of lubricating oil film, leading to premature wear and blow-by.

Pursuant to the present invention, coolant fluid from the main coolant chamber is caused to be drawn through each secondary cooling chamber inlet port 36 as provided by the scalloped recess and thence to be split in equal flow paths to each of the respective outlet ports 38, thence through the venturi, i.e. the radial passage forming the outlet port 38, and out the main cooling chamber outlet ports 32. By reason of the Bernoulli relationship between the fluid velocity and pressure, the high velocity flow of the main coolant stream through each outlet port 32 provides a reduced pressure head at the intersection with the venturi or radial passage 38. Thus the coolant within the secondary cooling chamber or channel 34 will be at a substantially higher pressure head than that which exists the radial passages 38, thereby inducing flow at a relatively high fluid velocity through the channel 34. In practice, it has been found that the fluid velocity through the secondary channel 34 will be, in the example given above, at least about three, and perhaps as much as six, feet per second. This, therefore, provides a very efficient means for removing a significant portion of the thermal energy per unit area of the cylinder liner at the uppermost region of the cylinder liner adjacent the combustion chamber.

Figure 3A:
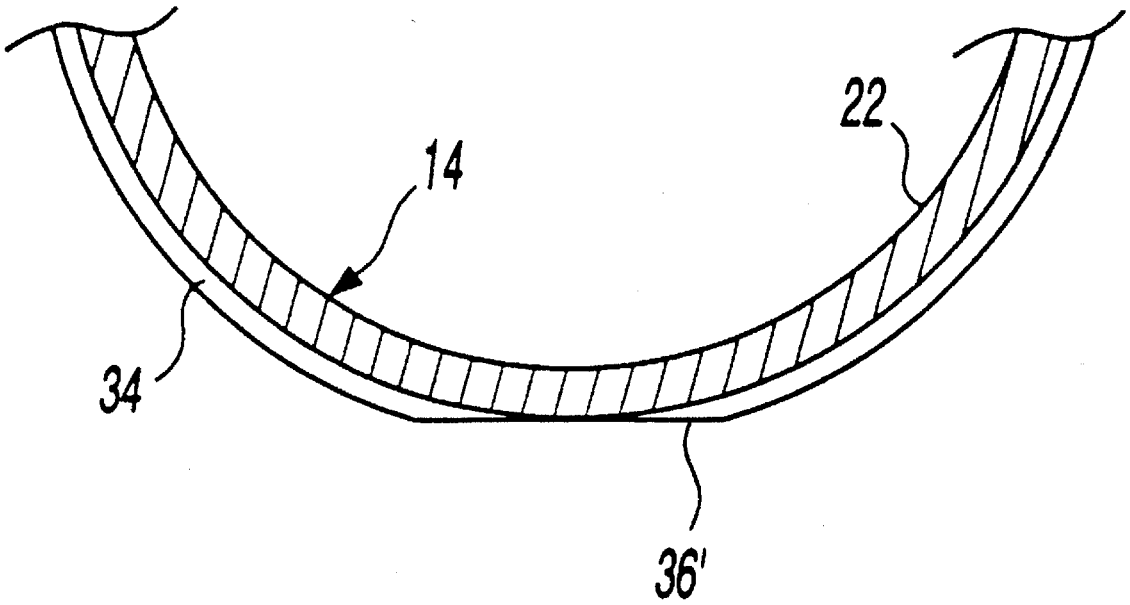
FIG. 3*a* is an alternative embodiment wherein the inlet port to the secondary cooling chamber is provided within the liner rather than cylinder block.

As an alternative to the scalloped recess forming inlet port 36 being constructed within the inner radial wall of the cylinder bore, the cylinder liner may be constructed with a flat chordal area 36'as shown in FIG. 3*a* of the same dimension (i.e. same axial length and circumferential or chord length) and within the same relative location of the above-described recess. The effect is the same, namely providing a channel communicating the coolant flow from the main coolant chamber 30 with that of the secondary cooling chamber channel 34.

Figure 4:
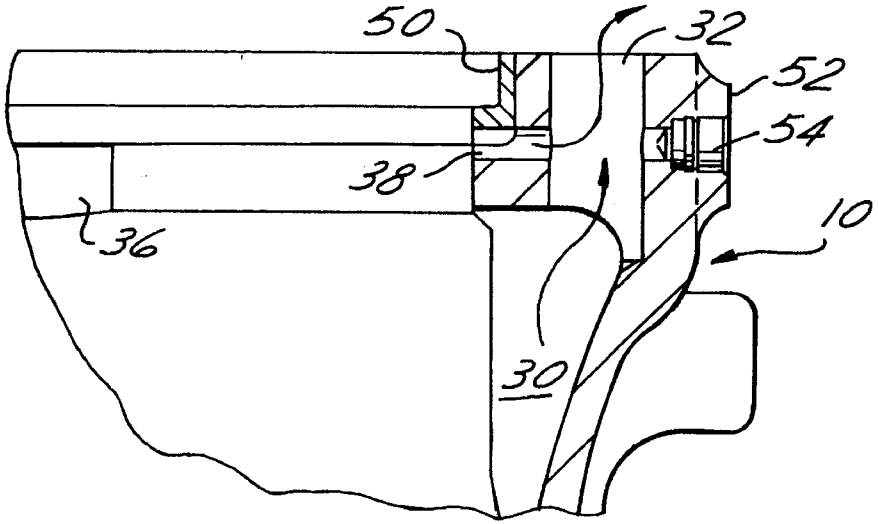
FIG. 4 is a partial cross-sectional view similar to FIG. 2 and showing an alternative embodiment of the present invention wherein the cylinder bore is provided with a repair bushing.

In FIG. 4, there is shown an alterative embodiment of the present invention, particularly applicable for re-manufactured cylinder blocks, whereby the cylinder bore includes a repair bushing 50 press fit within the cylinder block 10 and including the same stop shoulder 20 for receiving the cylinder liner. Likewise, the repair bushing and cylinder liner include a pair of radial passages extending therethrough to provide outlet ports 38 and thereby establishing coolant fluid flow between the secondary cooling chamber and the main outlet ports 32. Also as seen in FIG. 4, the radial extending passage of outlet port 38 is easily machined within the cylinder block by drilling in from the boss 52 and thereafter plugging the boss with a suitable machining plug 54.

Figure 5:
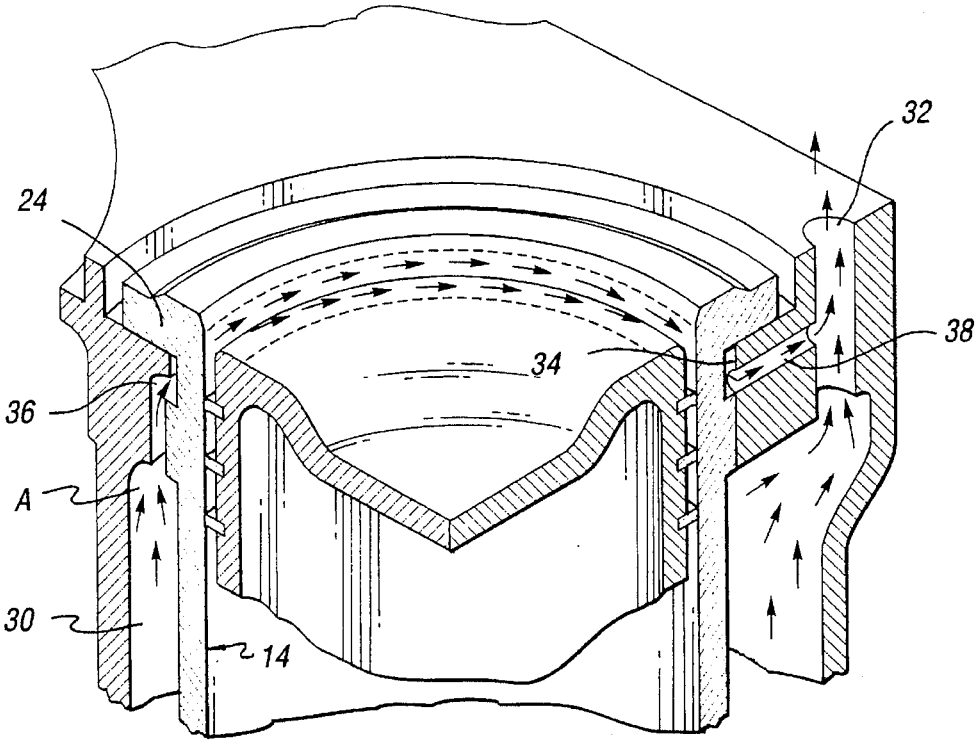
FIG. 5 is a partially cross-sectional perspective view of a single cylinder within a cylinder block showing the details of the secondary cooling chamber at the top of the cylinder liner and the coolant flow path therethrough in accordance with the present invention.
Figure 6:
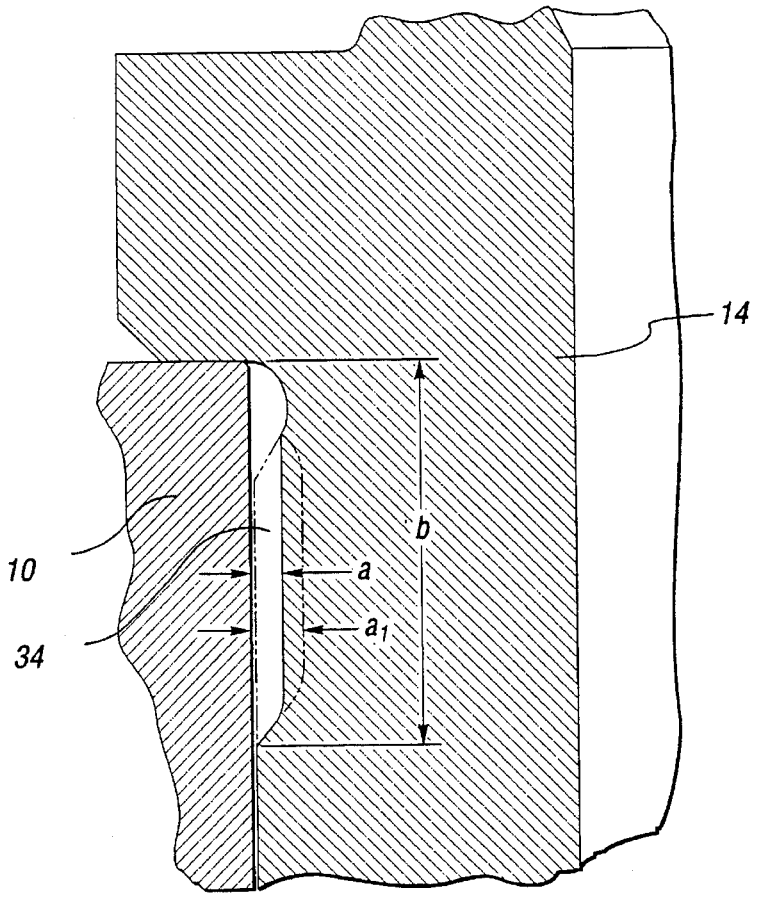
FIG. 6 is an enlargement view similar to FIG. 3 showing the top of the liner cooling channel in alternate cross-sectional flow area configuration in accordance with the present invention.

Another aspect of the present invention, apart from the vacuum flow induced cooling, is the flow characteristics of the upper cooling channel itself. This is illustrated with reference primarily to FIGS. 5 and 6. As shown in FIG. 5, in the prior art wherein no upper liner cooling channel nor inlet port 36 were provided, the point in the main cooling chamber 30, 90°distant from the outlet 32 and designated "A", is an area of stagnation, i.e. no coolant flow. Consequently, it was susceptible to producing hot spots on the liner. Adding the additional cooling channel and specific inlet points thereto as previously described did a great deal to eliminate the areas of stagnation. However, optimum cooling, namely, assuring uniform cylinder wall temperature, on the gas side and coolant side, about the circumference of the liner and at acceptable levels below boiling also requires optimizing the configuration of the upper channel itself. This means determining the most beneficial "aspect ratio" which is defined as width (a) of the channel divided by its height (b). This design criteria can also be equated to the hydraulic radius of cooling channel 34, with each being defined as the cross-sectional area of coolant passage in channel 34, divided by the wetted perimeter of the cooling channel 34. In the below noted formulation, the equivalent diameter (de) is equal to 4 times the hydraulic radius ($r_h$).

These design parameters were determined using the following design parameters:

---

Flow, Qs, in liner fillet channel is a function of flow,
Qm, thru the Hd/Blk water transfer hole, dia. Dm.
Qm=Q/12 ft^3/sec
where Q in gpm is the overall engine coolant flow rate.
Vm=Qm/Am: Velocity thru Blk-Head transfer holes, ft/sec.
P1−P2=r*Vm^2/2*gc: Pressure diff. across channel, lbf/ft^2
Vs=[2*(P1−P2)*de*gc/f*l*r]^1/2: Velocity in channel, ft/sec.
gc=32.2 lbm−ft/lbf−sec^2
a=channel width
b=channel height
l=.38394 ft; Channel length
r=63.74 lbm/ft^3: 50/50 Wtr/EG density @ 200° F.
f=friction factor--iterate using Moody diagram.
de=2*a*b/(a+b): Equivalent orifice diameter, ft.
Nr=r*Vs*de/u: Reynolds number, for use in Moody diagram.
u=0.000548 lbm/ft−sec: 50/50 Wtr/EG viscosity @ 200° F.
e=.00125 ft: Channel surface roughness estimate.
e/de=relative roughness, for use in Moody diagram.
Refine friction factor, f, using Moody diagram.
As=a*b: Channel area, ft^2
Qs=Vs*As: Channel coolant flow, ft^3/sec.
Qst=2*12*Qs*60*1728/231: Total engine channel flow, gpm. (2 channels per transfer hole, and 12 transfer holes).
Heat Transfer: The heat flow rate to the channel coolant (for one channel quadrant) is estimated by,
q=(Tg−Tb)/1/hgA + dx/Kl*pi*de*1 + 1/h*pi*de*l), Btu/hr
tg=avg. peak cylinder temp., degrees F.
Tb=bulk fluid temp. in the channel (avg. along flow dir.) degrees F.
hg=cyl ht transfer convection coefficient, Btu/hr−ft^2 - degrees F.
A=.0074 ft^2: Cyl ht transfer area, calculated from experimental data and combustion simulation model.
dx=(9-a)/25.4*12, liner wall thickness at channel, ft.
Kl=30 Btu/hr−ft−degrees F, liner thermal conductivity.
h=Nud*kc/de: Coolant side convection coefficient, Btu/hr−ft^2 - degrees F.
Nud=.023*Nr^0.8*Pr^0.4: Nusselt number, based on hydraulic dia.
Pr=cp*u/Kc=8.228: Prandtl number.
cp=0.884 But/lbm - degrees F: Specific Heat of 50/50 Wtr/EG @ 200° F.
Kc=0.212 Btu/hr−ft−degrees F, 50/50 Wtr/EG thermal conductivity @ 200° F.
Twc=Tb+q/h*pi*de*l: Coolant side liner wall temp., degrees F.
dT=Twc=246: Boiling Potential, degrees F.
Twg=q/(dx/Kl*pi*de*l)+Twc: Gas side liner wall temp., degrees F.
Tm=q/((dx-2)/Kl*pi*de*l)+Twc: Liner wall temp. @ thermocouple; 2.0 mm from inside liner wall
qt=24*q/60: Total engine channel heat rejection, Btu/min.

---

Testing of a 12.7 liter, 4 cycle diesel engine (assignee's Series 60 engine) equipped with top liner cooling as shown in FIGS. 1–3 and 5–6 yielded the following results:

12.7 L S60 'TLC' LINER CHANNEL COOLING ANALYSIS
50/50 Water/Ethylene Glycol Coolant

| a mm | b mm | Q gpm | As ft^2 | Dm mm | Vm ft/s | P1–P2 psf | de ft | Vs ft/s | Nr | e/de | f | Qs ft^3/s |
|---|---|---|---|---|---|---|---|---|---|---|---|---|
| 1.0 | 11.5 | 50 | 0.0001238 | 15.00 | 4.59 | 20.8 | 0.00604 | 2.26 | 1584 | 0.021 | 0.065 | 0.000279 |
| 1.0 | 11.5 | 60 | 0.0001238 | 15.00 | 5.50 | 29.9 | 0.00604 | 2.77 | 1943 | 0.021 | 0.062 | 0.000343 |
| 1.0 | 11.5 | 70 | 0.0001238 | 15.00 | 6.41 | 40.6 | 0.00604 | 3.28 | 2303 | 0.021 | 0.060 | 0.000406 |
| 1.0 | 11.5 | 80 | 0.0001238 | 15.00 | 7.32 | 53.0 | 0.00604 | 3.75 | 2631 | 0.021 | 0.060 | 0.000464 |
| 1.0 | 11.5 | 90 | 0.0001238 | 15.00 | 8.23 | 67.1 | 0.00604 | 4.25 | 2984 | 0.021 | 0.059 | 0.000526 |
| 1.0 | 11.5 | 100 | 0.0001238 | 15.00 | 9.15 | 82.8 | 0.00604 | 4.72 | 3315 | 0.021 | 0.059 | 0.000584 |
| 1.2 | 11.5 | 50 | 0.0001485 | 15.00 | 4.49 | 20.0 | 0.00713 | 2.48 | 2058 | 0.018 | 0.061 | 0.000368 |
| 1.2 | 11.5 | 60 | 0.0001485 | 15.00 | 5.38 | 26.6 | 0.00713 | 3.07 | 2545 | 0.018 | 0.057 | 0.000456 |
| 1.2 | 11.5 | 70 | 0.0001485 | 15.00 | 6.27 | 39.0 | 0.00713 | 3.58 | 2970 | 0.018 | 0.057 | 0.000532 |
| 1.2 | 11.5 | 80 | 0.0001485 | 15.00 | 7.16 | 50.8 | 0.00713 | 4.13 | 3422 | 0.018 | 0.056 | 0.000613 |
| 1.2 | 11.5 | 90 | 0.0001485 | 15.00 | 8.05 | 64.2 | 0.00713 | 4.68 | 3881 | 0.018 | 0.055 | 0.000695 |
| 1.2 | 11.5 | 100 | 0.0001485 | 15.00 | 8.94 | 79.1 | 0.00713 | 5.24 | 4349 | 0.018 | 0.054 | 0.000779 |
| 1.5 | 11.5 | 50 | 0.0001857 | 15.00 | 4.34 | 18.6 | 0.00871 | 2.78 | 2820 | 0.014 | 0.055 | 0.000617 |
| 1.5 | 11.5 | 60 | 0.0001857 | 15.00 | 5.19 | 26.6 | 0.00871 | 3.43 | 3470 | 0.014 | 0.062 | 0.000636 |
| 1.5 | 11.5 | 70 | 0.0001857 | 15.00 | 6.05 | 36.2 | 0.00871 | 4.03 | 4083 | 0.014 | 0.051 | 0.000749 |
| 1.5 | 11.5 | 80 | 0.0001857 | 15.00 | 6.90 | 47.1 | 0.00871 | 4.65 | 4707 | 0.014 | 0.050 | 0.000863 |
| 1.5 | 11.5 | 90 | 0.0001857 | 15.00 | 7.76 | 59.7 | 0.00871 | 2.23 | 5295 | 0.014 | 0.050 | 0.000971 |
| 1.5 | 11.5 | 100 | 0.0001857 | 15.00 | 8.82 | 73.5 | 0.00871 | 5.86 | 5936 | 0.014 | 0.049 | 0.001088 |
| 2.0 | 11.5 | 50 | 0.0002476 | 15.00 | 4.07 | 16.4 | 0.01118 | 3.11 | 4040 | 0.011 | 0.050 | 0.000769 |
| 2.0 | 11.5 | 60 | 0.0002476 | 15.00 | 4.87 | 23.5 | 0.01118 | 3.79 | 4931 | 0.011 | 0.048 | 0.000939 |
| 2.0 | 11.5 | 70 | 0.0002476 | 15.00 | 5.67 | 31.8 | 0.01118 | 4.46 | 5804 | 0.011 | 0.047 | 0.001105 |
| 2.0 | 11.5 | 80 | 0.0002476 | 15.00 | 6.47 | 41.4 | 0.01118 | 5.15 | 6692 | 0.011 | 0.048 | 0.001274 |
| 2.0 | 11.5 | 90 | 0.0002476 | 15.00 | 7.28 | 52.4 | 0.01118 | 5.79 | 7529 | 0.011 | 0.046 | 0.001433 |
| 2.0 | 11.5 | 100 | 0.0002476 | 15.00 | 8.07 | 94.5 | 0.01118 | 6.40 | 8442 | 0.011 | 0.046 | 0.001687 |

| Qst gpm | % Qst/Q | Nud | h Btu/ hr–ft^2–F | Tg deg F | Tb deg F | hg Btu/ hr–ft^2–F | q Btu/hr | Twc deg F | dT deg F | Twg deg F | Tm deg F | qt Btu/min |
|---|---|---|---|---|---|---|---|---|---|---|---|---|
| 3.01 | 6.0 | 19.4 | 681 | 1300 | 190 | 58 | 419 | 274 | 28 | 325 | 312 | 167 |
| 3.69 | 6.2 | 22.8 | 802 | 1275 | 190 | 64 | 452 | 267 | 21 | 322 | 308 | 181 |
| 4.37 | 6.2 | 26.2 | 919 | 1250 | 190 | 72 | 494 | 264 | 18 | 323 | 308 | 198 |
| 5.00 | 6.2 | 29.1 | 1022 | 1225 | 190 | 81 | 538 | 262 | 16 | 327 | 311 | 215 |
| 5.67 | 6.3 | 32.2 | 1130 | 1200 | 190 | 90 | 579 | 260 | 14 | 330 | 313 | 232 |
| 6.30 | 6.3 | 35.0 | 1230 | 1171 | 190 | 102 | 630 | 260 | 14 | 336 | 317 | 252 |
| 3.97 | 7.9 | 23.9 | 710 | 1300 | 190 | 58 | 434 | 261 | 15 | 304 | 293 | 174 |
| 4.91 | 8.2 | 28.3 | 843 | 1275 | 190 | 64 | 468 | 255 | 9 | 301 | 289 | 187 |
| 5.73 | 8.2 | 32.1 | 963 | 1250 | 190 | 72 | 512 | 252 | 6 | 303 | 290 | 205 |
| 6.60 | 8.3 | 35.9 | 1068 | 1225 | 190 | 81 | 559 | 251 | 5 | 306 | 292 | 224 |
| 7.49 | 8.3 | 39.7 | 1181 | 1200 | 190 | 90 | 602 | 249 | 3 | 309 | 294 | 241 |
| 8.39 | 8.4 | 43.5 | 1294 | 1171 | 190 | 102 | 658 | 249 | 3 | 314 | 297 | 263 |
| 5.57 | 11.1 | 30.8 | 749 | 1300 | 190 | 58 | 444 | 246 | 0 | 281 | 272 | 178 |
| 6.85 | 11.4 | 36.3 | 884 | 1275 | 190 | 64 | 479 | 242 | none | 279 | 269 | 191 |
| 8.06 | 11.5 | 41.4 | 1007 | 1250 | 190 | 72 | 524 | 240 | none | 281 | 270 | 210 |
| 9.30 | 11.6 | 46.3 | 1129 | 1225 | 190 | 81 | 573 | 238 | none | 283 | 271 | 229 |
| 10.46 | 11.6 | 50.9 | 1240 | 1200 | 190 | 90 | 618 | 237 | none | 386 | 273 | 274 |
| 11.72 | 11.7 | 56.8 | 1359 | 1171 | 190 | 102 | 675 | 237 | none | 290 | 276 | 270 |
| 8.29 | 16.6 | 41.0 | 778 | 1300 | 190 | 58 | 453 | 233 | none | 259 | 252 | 181 |
| 10.11 | 16.9 | 48.1 | 912 | 1275 | 190 | 64 | 489 | 230 | none | 258 | 250 | 196 |
| 11.90 | 17.0 | 54.8 | 1039 | 1250 | 190 | 72 | 536 | 228 | none | 259 | 250 | 214 |
| 13.73 | 17.2 | 81.4 | 1165 | 1225 | 190 | 81 | 587 | 227 | none | 261 | 251 | 235 |
| 15.44 | 17.2 | 67.5 | 1280 | 1209 | 190 | 90 | 634 | 227 | none | 263 | 252 | 253 |
| 17.31 | 17.3 | 74.0 | 1403 | 1171 | 190 | 102 | 693 | 227 | none | 268 | 255 | 277 |

KEY:
Parameters tried (bold)
Exp/Simulation Data Matching (italics)

These results are based on a 50/50 water/ethylene glycol coolant.

Notably, boiling potential (dT) is eliminated at an aspect ratio (a/b) of 0.130 and above and a equivalent diameter of 0.008 ft and above, as provided when the channel width is increased to 1.5 mm and 2.0 mm.

The foregoing description is of a preferred embodiment of the present invention and is not to be read as limiting the invention. The scope of the invention should be construed by reference to the following claims.

What is claimed is:

1. In combination, in an internal combustion engine, a cylinder block, having at least one cylinder bore;

a cylinder liner concentrically located within said cylinder bore and secured to said cylinder block;

a main cooling chamber surrounding said cylinder liner and having an inlet port and at least one outlet port for circulating a coolant fluid about a main portion of said cylinder liner;

a secondary cooling chamber located about the uppermost portion of said cylinder liner, said secondary cooling chamber having at least one inlet port and at least one outlet port, said ports being spaced from one another by a substantial distance about the circumference of said secondary cooling chamber, whereby fluid coolant circulated about said secondary coolant chamber is divided into two separate flow paths about said secondary cooling chamber and exiting through said secondary cooling chamber outlet port;

said secondary cooling chamber being generally rectangular in cross-section and having an aspect ratio ranging from about 0.085:1 to about 0.175:1, thereby providing a flow of coolant fluid through said secondary cooling chamber at a flow velocity of substantial magnitude and a significantly increased rate of removal of thermal energy per unit area of said cylinder liner at the uppermost portion of said cylinder liner.

2. The invention of claim 1 wherein said aspect ratio ranges from about 0.130:1 to about 0.175:1.

3. The invention of claim 1 wherein said aspect ratio is at least 0.130:1.

4. In combination, in an internal combustion engine, a cylinder block, having at least one cylinder bore;

a cylinder liner concentrically located within said cylinder bore and secured to said cylinder block;

a main cooling chamber surrounding said cylinder liner and having an inlet port and at least one outlet port for circulating a coolant fluid about a main portion of said cylinder liner;

a secondary cooling chamber located about the uppermost portion of said cylinder liner, said secondary cooling chamber having at least one inlet port and at least one outlet port, said ports being spaced from one another by a substantial distance about the circumference of said secondary cooling chamber, whereby fluid coolant circulated about said secondary coolant chamber is divided into two separate flow paths about said secondary cooling chamber and exiting through said secondary cooling chamber outlet port;

said secondary cooling chamber being open to the adjacent cylinder block and defining therewith an enclosed chamber, the equivalent diameter of said secondary cooling chamber as defined by the cross-sectional area of passage of said chamber relative to the wetted perimeter of said chamber ranging from about 0.006 ft to about 0.0112 ft.

5. The invention of claim 4 wherein said equivalent diameter ranges from about 0.008 to about 0.0112 ft.

6. In combination, in an internal combustion engine, a cylinder block, having at least one cylinder bore;

a cylinder liner concentrically located within said cylinder bore and secured to said cylinder block;

a main cooling chamber surrounding said cylinder liner and having an inlet port and at least one outlet port for circulating a coolant fluid about a main portion of said cylinder liner;

a secondary cooling chamber located about the uppermost portion of said cylinder liner, said secondary cooling chamber having at least one inlet port and at least one outlet port, whereby said fluid coolant may be circulated simultaneously about said main cooling chamber and said secondary cooling chamber, said ports being spaced from one another by a substantial distance about the circumference of said secondary cooling chamber, whereby fluid coolant circulated about said secondary coolant chamber is divided into two separate flow paths about said secondary cooling chamber and exiting through said common outlet port;

said outlet port of said secondary cooling chamber being in fluid communication with the outlet port of said main cooling chamber and comprising a venturi whereby, as coolant from the main cooling chambers flows through the outlet port of said main cooling chamber, there will be created across said venturi a pressure drop which in turn will induce the flow of coolant fluid through said secondary cooling chamber at a flow velocity sufficient to provide a significantly increased rate of removal of thermal energy per unit area of said cylinder liner at the uppermost portion of said cylinder liner; and said secondary cooling chamber being generally rectangular in cross-section and having an aspect ratio of at least about 0.130:1.

7. A method of cooling a cylinder liner within the cylinder block of an internal combustion engine comprising;

providing a cylinder liner concentrically located within said cylinder bore and secured to said cylinder block;

providing a main coolant passage surrounding said cylinder liner and having an inlet port and outlet port for circulating a coolant fluid about a main portion of said cylinder liner;

providing a secondary cooling chamber concentrically located about the uppermost portion of said cylinder liner, said secondary cooling chamber being provided with an inlet port and an outlet port whereby said fluid coolant may be circulated simultaneously about said main coolant chamber and said secondary coolant chamber;

said outlet port of said secondary cooling chamber being in fluid communication with the outlet port of said main coolant chamber and comprising a venturi whereby, as coolant from the main cooling chamber flows through the outlet port of said main cooling chamber, there will be created across said venturi a pressure drop which in turn will induce the lower of coolant fluid through said secondary cooling chamber at a flow velocity of sufficient magnitude relative to that flowing through said outlet port, whereby there is provided a significantly increased rate of removal of thermal energy per unit area of said cylinder liner at the uppermost portion of said cylinder liner; and said secondary cooling chamber being generally rectangular in cross-section and having an aspect ratio ranging from about 0.085 to about 0.175, thereby providing a flow of coolant fluid through said secondary cooling chamber at a flow velocity of substantial magnitude and a significantly increased rate of removal of thermal energy per unit area of said cylinder liner at the uppermost portion of said cylinder liner.

8. In combination, in an internal combustion engine, a cylinder block, having at least one cylinder bore;

a cylinder liner concentrically located within said cylinder bore and secured to said cylinder block;

a main cooling chamber surrounding said cylinder liner and having an inlet port and at least one outlet port for circulating a coolant fluid about a main portion of said cylinder liner;

a secondary cooling chamber located about the uppermost portion of said cylinder liner, said secondary cooling chamber having at least one inlet port and at least one outlet port, said ports being spaced from one another by a substantial distance about the circumference of said secondary cooling chamber, whereby fluid coolant circulated about said secondary coolant chamber is divided into two separate flow paths about said secondary cooling chamber and exiting through said secondary cooling chamber outlet port;

said secondary cooling chamber being generally rectangular in cross-section and having an aspect ratio of at least 0.130:1 and an equivalent diameter of at least 0.008 ft, thereby providing a flow of coolant fluid through said secondary cooling chamber at a flow velocity of substantial magnitude and a significantly increased rate of removal of thermal energy per unit area of said cylinder liner at the uppermost portion of said cylinder liner.

* * * * *

UNITED STATES PATENT AND TRADEMARK OFFICE

CERTIFICATE OF CORRECTION

PATENT NO. : 5,505,167
DATED : April 9, 1996
INVENTOR(S) : Lawrence C. Kennedy

It is certified that error appears in the above-indentified patent and that said Letters Patent is hereby corrected as shown below:

Col. 6, line 51, delete "But/lbm" and insert --Btu/lbm--.

Col. 8, line 24, delete "2.23" and insert --5.23--.

Col. 8, line 21, delete "0.062" and insert --0.052--.

Col. 8, line 29, delete "0.048" and insert --0.046--.

Col. 7, line 54, delete "56.8" and insert --55.8--.

Col. 7, line 58, delete "81.4" and insert --61.4--.

Col. 8, line 48, delete "658" and insert --656--.

Col. 8, line 41, delete "268" and insert --266--.

Col. 8, line 53, delete "274" and insert --247--.

Signed and Sealed this

Sixteenth Day of July, 1996

*Attest:*

Bruce Lehman

BRUCE LEHMAN

*Attesting Officer*

*Commissioner of Patents and Trademarks*